US005441320A

United States Patent [19]

Strong

[11] Patent Number: 5,441,320

[45] Date of Patent: Aug. 15, 1995

[54] BOTTLE CARRIER

[75] Inventor: Bernard Strong, Tarzana, Calif.

[73] Assignee: Propak-California Corp., La Puente, Calif.

[21] Appl. No.: 302,225

[22] Filed: Sep. 6, 1994

Related U.S. Application Data

[63] Continuation of Ser. No. 44,270, Apr. 7, 1993, abandoned.

[51] Int. Cl.[6] ..... B65D 71/00

[52] U.S. Cl. ..... 294/31.2; 206/150; 206/151; 294/33; 294/87.2

[58] Field of Search ..... 294/27.1, 31.2, 33, 294/87.2–87.28, 137, 159, 164, 166, 170; 206/145, 147, 150–153, 158, 199, 201, 427, 428

[56] References Cited

U.S. PATENT DOCUMENTS

| | | | |
|---|---|---|---|
| 257,426 | 10/1980 | D'Alo | D9/292 |
| 277,554 | 2/1985 | Chabot | D9/434 |
| 348,002 | 6/1994 | Jones | D9/455 |
| 349,459 | 8/1994 | Borg | D9/455 |
| 1,377,931 | 5/1921 | Samuels | 294/87.22 |
| 1,863,136 | 6/1932 | Hood et al. | 294/33 |
| 2,301,167 | 11/1942 | Cosme | 294/87.2 |
| 2,398,948 | 4/1946 | Martinez | 294/87.22 |
| 2,408,249 | 9/1946 | Cohn | 294/87.28 |
| 2,440,902 | 5/1948 | Lutey | 224/45 |
| 2,823,062 | 2/1958 | Toensmeier | 294/87.2 |
| 2,823,063 | 2/1958 | Toensmeier | 294/87.2 |
| 2,823,064 | 2/1958 | Toensmeier | 294/87.2 |
| 2,865,669 | 12/1958 | Linthicum | 294/87.2 |
| 3,421,790 | 1/1969 | Carson | 294/87.26 |
| 3,514,797 | 6/1970 | Zysman | 5/345 |
| 3,633,962 | 1/1972 | Erickson | 294/87.2 |
| 4,093,295 | 6/1978 | Erickson | 294/87.2 |
| 4,139,094 | 2/1979 | Berry et al. | 206/158 |
| 4,678,221 | 7/1987 | Josenhans | 294/170 |
| 4,852,730 | 8/1989 | Thykeson | 206/145 |
| 4,911,289 | 3/1990 | Bird | 294/87.2 X |
| 4,917,428 | 4/1990 | Sola | 294/87.28 |

FOREIGN PATENT DOCUMENTS

| | | | |
|---|---|---|---|
| 2144335 | 3/1973 | Germany | 294/87.2 |
| 128654 | 6/1950 | Sweden | 294/87.2 |
| 2163344 | 2/1986 | United Kingdom | 294/87.2 |

*Primary Examiner*—Johnny D. Cherry
*Attorney, Agent, or Firm*—Lyon & Lyon

[57] ABSTRACT

A bottle carrier unit which attaches to the necks of one or more bottles for lifting and carrying the bottles. The two-bottle carrier unit is a support device with first and second collars attachable to respective necks of a pair of bottles, the collars being supported on opposite sides of a central handle section, with a longitudinal slit or gap bisecting the central handle section and a radial portion of each collar adjacent thereto. The slit allows the bisected handle sections to be pulled apart, thereby enlarging the size of the collars to facilitate insertion and removal of the bottles. The slit also allows for the torques applied by carrying the unit or the forces applied by grasping the handles to provide additional connection strength to the collars onto the bottle necks. The handle sections may include side stiffening members for providing structural stiffness thereto.

19 Claims, 3 Drawing Sheets

BOTTLE CARRIER

This is a continuation of application Ser. No. 08/044,270 filed on Apr. 7, 1993, now abandoned.

BACKGROUND OF THE INVENTION

The field of the present invention relates to a device for carrying objects, more particularly to a bottle carrier which supports and carries one or more containers in a desired arrangement.

Various bottle carriers designed to support a plurality of bottles by their necks have been proposed. Some of these carriers, such as those shown in U.S. Pat. No. 4,139,094 or U.S. Pat. No. 2,823,063, include an upper tray portion with openings of a design to accept the neck of a bottle. The strength of the structure and its ability to hold each bottle is essentially dependent solely upon the stiffness and strength of the opening which grasps the bottle neck. Typically, it is difficult to insert a bottle neck into the opening and once inserted and then removed, the edges of the opening are damaged and become unusable. These units, however, are most aptly designed for smaller bottles and are frequently in a six-pack type of configuration where removal is accomplished by ripping the bottle away from the carrier.

In U.S. Pat. No. 4,235,468 or U.S. Pat. No. 3,633,962, each of the bottle necks are contained or held within an individual frame member interconnected with the other individual frames by a stiff connecting structure. Again the strength of the carrier connection to a respective bottle neck is dependent solely upon the connection stiffness strength of the individual frame member. Because of the required stiffness of the frame member, it is difficult to install the frame member on a bottle neck and even more difficult to effect removal. In addition, in order to provide sufficient connection strength, the devices are necessarily complex and relatively massive. Such complexities increase construction costs and relative massive size increases material costs of manufacture.

As such, it is desirable to have a device for carrying multiple containers which is of simple design and low cost which avoids the limitations of the prior devices.

Summary of the Invention

The present invention is a container carrier or, more particularly, a bottle carrier which may be used to support and carry one or more bottles. In a preferred embodiment, the carrier comprises a two-bottle carrier unit which attaches to the necks of one or more bottles for lifting and carrying the bottles. The two-bottle carrier unit has first and second collars attachable to respective necks of a pair of bottles. The collars are supported on opposite sides of a central handle section, with a longitudinal slit or gap bisecting the central handle section and a radial portion of each collar adjacent thereto. The slit allows the bisected handle sections to be pulled apart, thereby enlarging the size of the collars to facilitate insertion and removal of the bottles. The slit also allows for the torques applied by carrying the unit or the forces applied by grasping the handles to provide additional connection strength to the collars onto the bottle necks.

Detailed Description of the Preferred Embodiments

Figure 5:
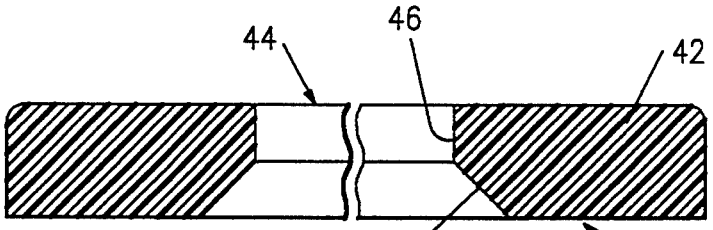
FIG. 5 is a cross section of the collar portion of the bottle carrier of FIG. 2 taken along the line 5—5.
Figure 6:
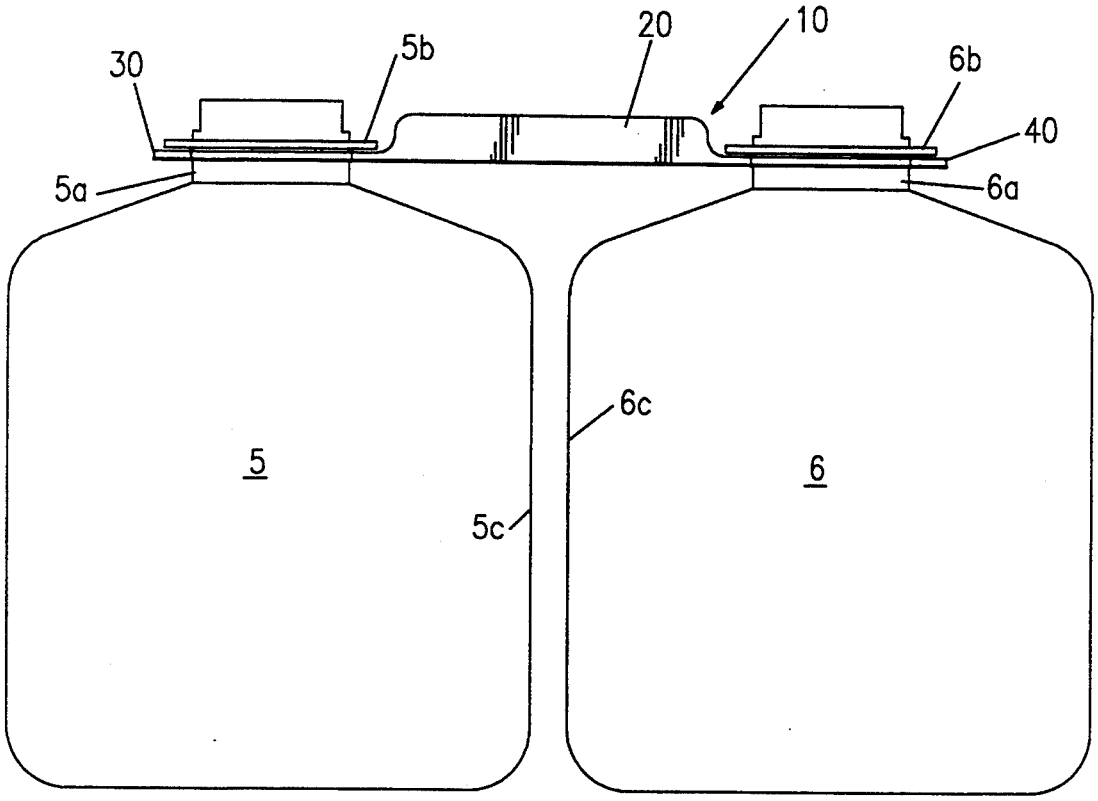
FIG. 6 is a side elevation view of a bottle carrier with a pair of bottles attached thereto.

FIGS. 1–6 illustrate a preferred embodiment for a container carrier 10 equipped to support and carry two bottles 5, 6 (the bottles being shown in FIG. 6). The carrier device 10 includes a central web or central handle portion 20 having connector collars 30, 40 attached thereto on either end of the central handle 20. The carrier 10 is preferably injection molded in a single piece of plastic, preferably high molecular weight polypropylene. The central handle 20 is comprised of a pair of flat panel sections or web portions 22, 24 separated by a longitudinal slit 25 of a gap "G" therebetween. The respective collars 30, 40 are attached on opposite ends of the web portions 22, 24. The first collar 30 is comprised of a flat ring portion 32 having a central aperture 34. On the end of the ring portion 32 at which the collar 30 is attached to the central portion 20, the ring portion 32 includes a radial slit 35 (of a gap G) which is co-linear with the longitudinal slit 25 between the first and second web portions 22, 24. Similarly, the second collar 40 is comprised of a flat ring portion 42 having a central aperture 44 and a radial slit 45 (of a gap G) in the ring portion 42 which is co-linear with the longitudinal slit 25.

As viewed in FIG. 5, the inner surface of the central aperture 44 includes an inner circumferential edge 46 which merges into a slant or ramp portion 48. The ramp portion 48 facilitates sliding contact of the bottle neck during insertion of the bottle neck into the aperture 44 within the collar 40.

Figure 4:
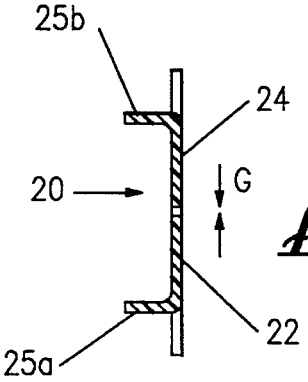
FIG. 4 is a cross section of a central handle portion of the bottle carrier of FIG. 1 taken along the line 4—4.

As shown in FIG. 4, the central web section 20 includes a pair of flat panel sections 22, 24 and a reinforcing or stiffening element **25*a*, 25*b* which extends over substantially the entire length of the central portion 20 allowing an outer periphery thereof. Together the flat panel section 22 and the orthogonally positioned stiffening element 25*a* (or flat portion 24 and stiffening element 25*b***) form an angle shaped structure.

The above-described carriers have been illustrated for carrying two bottles. In such a construction, the size of the unit is designed to accommodate the particular size of bottle or container upon which the carrier is to be used. In the example of two one-gallon bottles of milk, such as is illustrated in FIG. 6, the distance between the center points of the collars 30, 40 is approximately equal to the diameter from side to side of the container 5 or 6. The containers 5, 6 are arranged in a side-by-side relationship with the flat sides 5*c*, 6*c* positioned against one another. In order to facilitate insertion of a container 5, 6 into the collars 30, 40, the user grasps the first and second web portions 22, 24 and pulls them apart thereby enlarging the respective apertures 34, 44. Once the bottle necks have been inserted, the user releases the handle portions 22, 24 and the collars 30, 40 are secured to the bottle necks 5*a*, 6*a*. When lifting the carrier unit 10, the bottles 5, 6 are urged against one another by gravity attempting to pivot about the respective collars 30, 40 to which they are secured. This force tends to apply a torque to the collars 30, 40 reducing the gap G thereby providing additional securing strength to the collars 30, 40. Grasping or squeezing the central handle portion 20 also reduces the gap G providing further securing forces to the collars 30, 40.

To facilitate removal of the bottles, the user again pulls apart the handle portions 22, 24 thereby enlarging the respective apertures 34, 44 and releasing the bottles 5, 6.

It may also be noted that the more the user might shake the carrier and bottles during transport, for example if the user were to move quickly with the assemblage, the more likely the user would more firmly grip the handle portion 20 providing additional securement force to the collars 30, 40.

The longitudinal slit 25 and the radial slits 35, 45 provide for the requisite separability for carrier parts allowing for separability to facilitate bottle removal and insertion and permitting connection strength enhancement. In a preferred application for a two-bottle carrier unit for a pair of one gallon plastic milk bottles, the first collar 30, the second collar 40 and the first and second web portions 22, 24 are relatively thin flat plates disposed in a co-planar arrangement. In an "at-rest" position (one in which the user is not pulling the first and second web portions 22, 24 apart), the gap "G" is preferably 1/16 of an inch (1.57 mm) or alternately may have a preferred range of 1/32 to ¼ inches (0.79 to 6.35 mm). The size of the gap G is selected for the particular application in an amount to allow for desired inward movement of the parts to provide the collar connection strength enhancement and also inhibit pinching of the user's skin.

Figure 7:
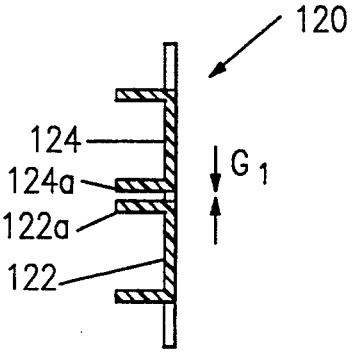
FIG. 7 is a cross sectional view of an alternate central section having a channel design.

Other shape structures may be implemented to provide the desired stiffness for the carrier unit. FIG. 7 illustrates a cross section for a central portion of an alternate embodiment for a carrier 120 comprising first and second web portions 122, 124 comprising a channel shaped structure. In such a construction, the center channel legs 122*a*, 124*a* are separated by the requisite gap $G_1$. The proximity of the channel legs 122*a*, 124*a* to each other makes the desired gap $G_1$ preferably somewhat larger than the gap of the previous embodiment, that is, in the order of 3/16th inches (4.75 mm). When grasped, the first and second web portions 122, 124 are urged together to provide the additional gripping strength of respective collars about the necks of the bottles.

Figure 8:
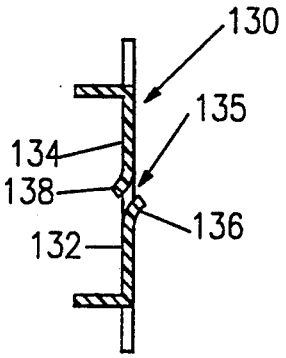
FIG. 8 is a cross sectional view of an alternate central section having an offset design.

FIG. 8 illustrates yet another embodiment in cross section of a central portion 130. The central portion 130 is similar to that previously described with respect to FIG. 4 except the central portion of the first and second web sections 132, 134 include offset or angled end pieces 136, 138 angled in opposite directions to one another. This embodiment still includes a longitudinal slit 135. The offset or angled pieces 136, 138 are continued throughout the central portion 130 all the way outward to respective apertures of the collars. When grasped by the user and squeezed, the angled portions 136, 138 will overlap, if required, engaging in a sliding contact, to a degree depending upon the force applied by the user. The overlapping design allows the unit to provide additional connection strength to the respective collars. The overlapping design may also inhibit any pinching action on the user's hand.

Other overlapping designs may be implemented by one skilled in the art such as for example a tongue-and-groove arrangement or an offset, side-by-side sliding arrangement (without the angled pieces).

Figure 9:
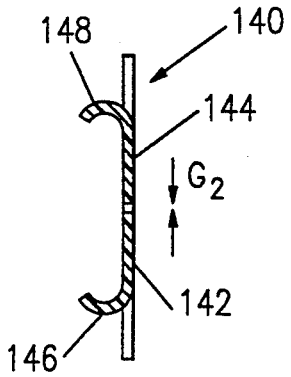
FIG. 9 is a cross sectional view of an alternate central section having a curved stiffening member.

FIG. 9 illustrates yet another alternative embodiment for the design of the central portion 140. In this embodiment, the central portion 140 includes first and second web sections 142, 144, similar to that described as in FIG. 4, but the angled stiffening elements are modified to comprise curved elements 146, 148. The curved element 146 extends inward in a curved, semicircular structure from the first web section 142, and the inwardly curved element 148 extends inward in a semicircular structure from the second web section 144. A slit of a distance or gap $G_2$ is preferably maintained in the at-rest position. The inwardly curved stiffening sections 146, 148 provide a curved shape resulting in a more comfortable gripping surface for the user's hand.

Figure 10:
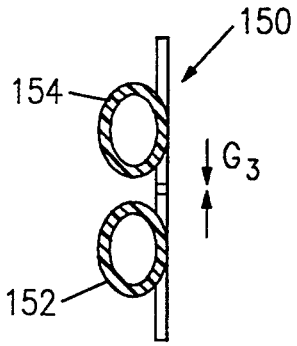
FIG. 10 is a cross sectional view of an alternate central section having a tubular stiffening member.

Taking the curved surface design to an extreme, FIG. 10 illustrates another alternative central handle section 150 comprising a first tubular web section 152 placed in parallel with the second tubular web section 154. The first and second tubular web sections 152, 154 are separated by a gap $G_3$. Since the circular structure of the tubular sections 152, 154 will inhibit overlapping, the size of the gap $G_3$ is preferably slightly larger than the gap of the previous embodiment of FIG. 4, preferably about 3/16th inches (4.75 mm). The round shape of the tubular webs 152, 154 provides a comfortable gripping and lifting surface for the user's hand. The injection molding process for such a design may be somewhat more complicated, such as requiring the use of draw pins to form the hollow channels within the tubular webs 152, 154, but one skilled in the art could construct a suitable mold for fabricating such a design.

Other structural designs may be suitable for a given application. It is noted that there are several factors in choosing a particular design including functionality, comfort to the user, molding costs, and material costs. The design of the central portion 140 of FIG. 9 would require more material to achieve the same stiffness as the design of FIG. 4 but may be somewhat more comfortable to the user due to its curved shape. Similarly, the design of the central portion 150 of FIG. 10 may be modified to have a solid rod for the central web sections 152, 154 (filling in the hollow areas). Though such a design would provide a stiffer structure, it would require additional material resulting in higher material cost though manufacturing costs may be reduced due to simplification of the molding process.

As for the design of the central section 130 of FIG. 8, it is preferred that the curved central portions 136, 138 do not overlap in the at-rest state or at least in the molding process to facilitate releasability from the mold during the injection molding process.

Figure 11:
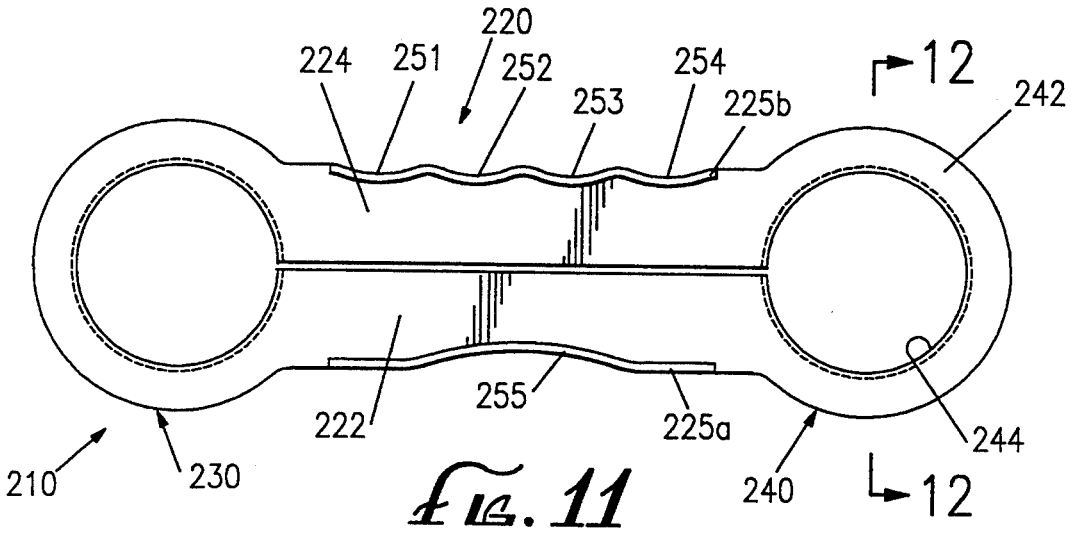
FIG. 11 is a top plan view of an alternate bottle carrier having finger indentations.

Other designs may provide additional comfort features for the user. FIG. 11 illustrates an alternative carrier 210 having first and second collars 230, 240 joined together by a central handle 220. The central handle 220 is comprised of web portions 222, 224. As in previous embodiments, the first web portion 222 includes a stiffening element 225*a* and the second web portion 224 includes a stiffening element 225*b*. A plurality of finger indentations comprising four indentations 251, 252, 253, 254 are molded into the sides of the second web portion 224 and stiffening element 225*b* which accommodate the user's four fingers when gripping the handle portion 220. Similarly, the first web portion 222 and stiffening element 225*a* may include one or more indented portions; in this embodiment a single indented portion 255 is included for accommodating the user's thumb.

Figure 1:
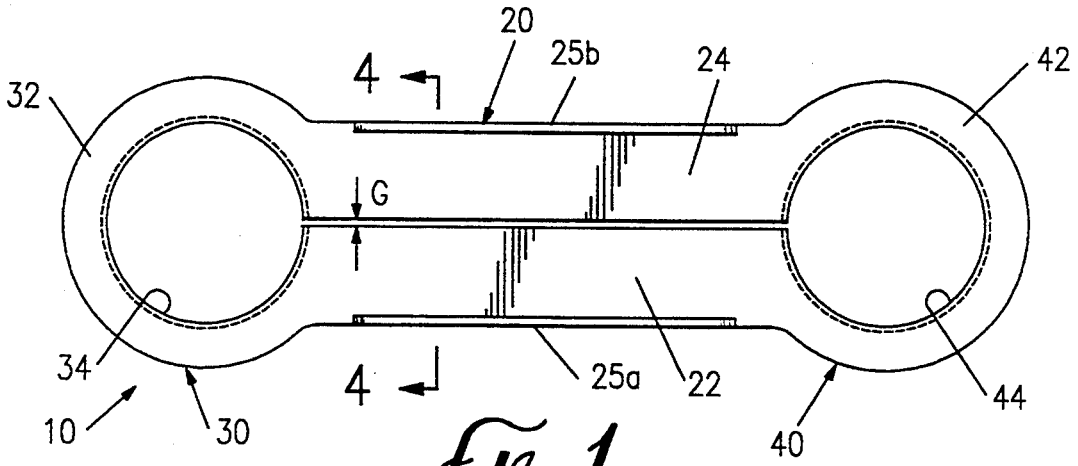
FIG. 1 is a top plan view of a dual bottle carrier according to the present invention.
Figure 2:
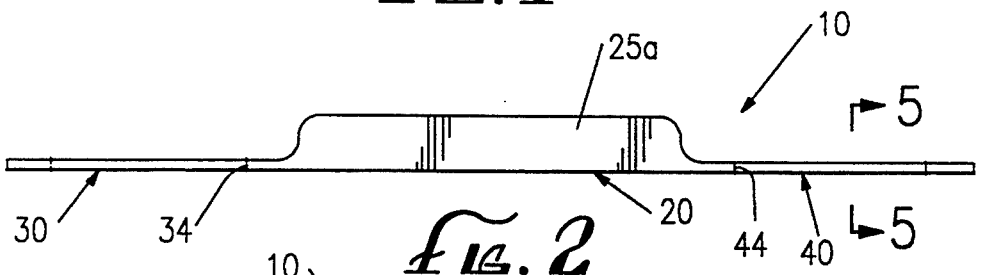
FIG. 2 is a side elevation view of the bottle carrier of FIG. 1.
Figure 3:
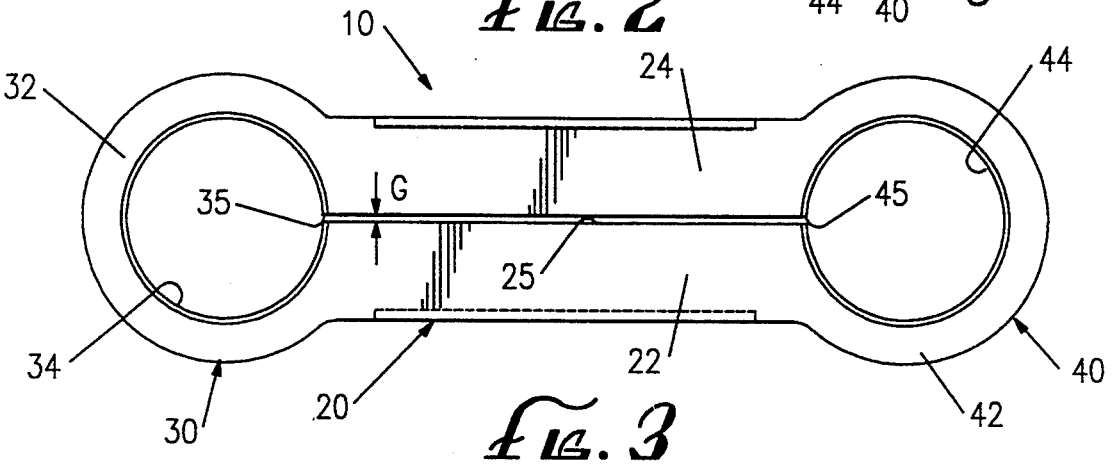
FIG. 3 is a bottle plan view of the bottle carrier of FIG. 1.
Figure 12:
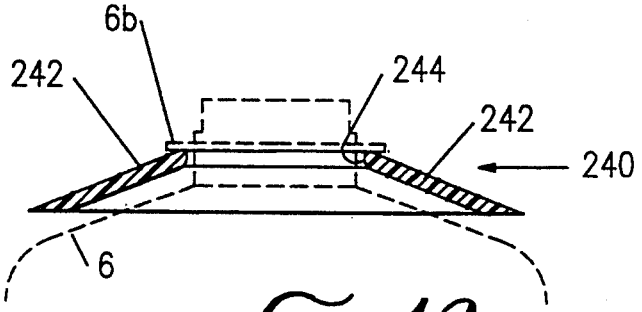
FIG. 12 is a cross sectional view of an alternate collar design having an angular configuration.

Alternate designs may also be implemented for the collars 30, 40 (as in FIG. 1). The collars 30, 40 and the central handle section 20 are preferably of a flat planar construction of uniform thickness of approximately 3/32 inches (0.238 cm) with the elements being arranged in a coplanar configuration with stiffening elements 25*a*, 25*b* extending orthogonally outward from the plane of the other elements. The shape of the collars 30, 40 is generally a flat ring shape construction. The ring portions 32, 42 are of thin and flat flat construction, for providing a stiff structure in a radial direction relative to a more flexible structure in a direction perpendicular to the radial direction. As shown in the FIGS. 1 and 2, the width of the ring in the radial direction is relatively large as compared to the thickness of the ring perpendicular to the radial direction. The thickness of the ring is approximately 3/32 inches (0.238 cm.) In general, the flat ring is constructed to be installed in a plane perpendicular to an axis of the container as best viewed in FIG. 6. FIG. 12 illustrates an alternate embodiment where the ring portion 242 of the collar 240 is slanted or angled slightly from orthogonal to the axis of the container. The size of the angle will depend upon the particular application including the size and weight of the container. It is anticipated the angle may range from 5° to 45°. The angular structure will assist in gripping action on the bottle and also assist in installation allowing the bottle neck to slide up the sloped ring portion 242 assisting in urging the ring portion 244 apart to allow insertion of the bottle neck.

Figure 13:
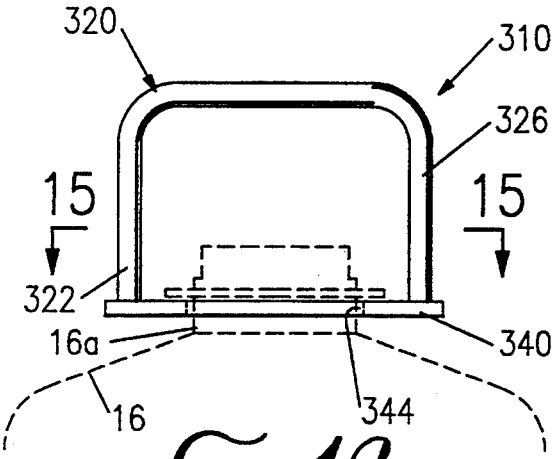
FIG. 13 is a side elevation view of an alternate carrier unit for a single container.
Figure 14:
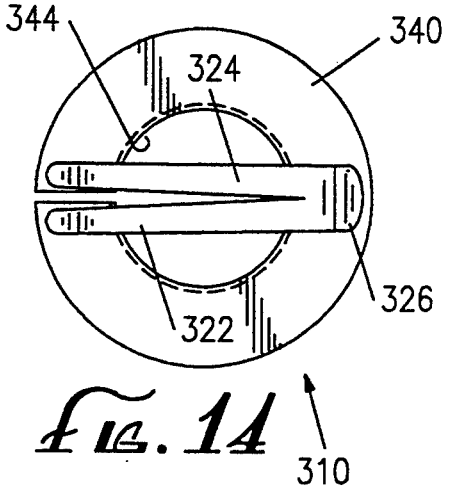
FIG. 14 is a top plan view of the carrier unit of FIG. 14.
Figure 15:
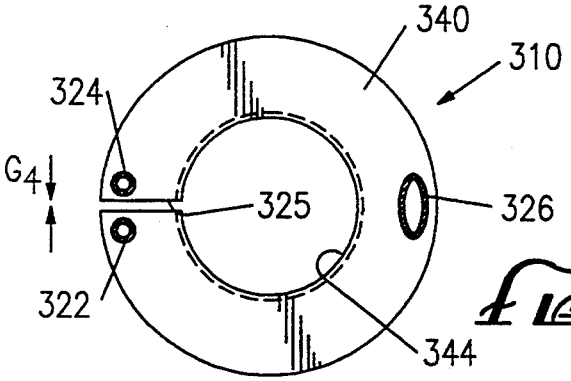
FIG. 15 is a cross section of the collar portion of the bottle carrier of FIG. 13 taken along the line 15—15.

Though the above embodiments have specifically discussed only configurations for a pair of containers, a container carrier for other numbers of bottles may be implemented. FIGS. 13–15 illustrate an alternative carrier 310 for use in carrying a single container or bottle 16. The carrier 310 includes a collar 340 which is a flat ring-shaped disc having a central aperture 344 and a radial slit 325 of similar configuration as in the above two bottle designs. The handle section 320 is comprised of first and second handle portions 322, 324 which are attached to the collar 340 on respective opposite sides of the radial slit 325. The first and second handle portions 322, 324 are U-shaped extending around from one side of the collar 340, joining together and as a single leg 326 adjoining to an opposite side of the collar 340.

In operation, the first and second handle sections 322, 324 are pulled apart to facilitate insertion of the bottle neck into the aperture 344 by increasing the gap $G_4$ at the radial slit 325. Once in place, the user grasps the handle sections 322, 324 urging them together (by the lifting action and the resulting torques applied by the bottle and/or by the squeezing of the handle sections together) to provide additional connection strength to the collar 340 around the bottle neck 16*a*.

The alternate embodiments may be assembled in various combinations. For example, a pair of the U-shaped carriers 310 may be interconnected by a central bisected handle, such as the handle 150 of FIG. 10, with one tubular element 152 attached to the first handle portion 322 and the second tubular element 154 attached to the second handle portion 324.

Thus, a container carrier unit has been shown and described. Though certain examples and advantages have been disclosed, further advantages and modifications may become obvious to one skilled in the art from the disclosures herein. The invention therefore is not to be limited except in the spirit of the claims that follow.

What is claimed is:

1. A bottle carrier comprising a one-piece injection molded construction including a first collar and a second collar in coplanar arrangement and being tangentially connected to opposite sides of a central handle piece, the first and second collars each having a radial slit along a radius proximate to respective connection to the central handle piece, the central handle piece comprising a first web portion connected at opposite ends thereof to the first and second collars on one side of the respective radial slits and a second web portion parallel to the first web portion connected at opposite ends thereof to the first and second collars on the other side of the respective slits, wherein each of the first and second collars comprises a ring means, of thin and flat plate construction, for providing a stiff structure in a radial direction and a flexible structure in a direction perpendicular to the radial direction, the ring means having a circular central aperture into which a bottle neck may be inserted.

2. A bottle carrier according to claim 1 wherein the central handle piece includes a longitudinal slit between the first and second web portions, the longitudinal slit being co-linear with the radial slits of both the first and second collars.

3. A bottle carrier according to claim 2 wherein in an at-rest, unattached condition, the longitudinal slit and the radial slits comprise a gap of predetermined width.

4. A bottle carrier according to claim 2 wherein when the carrier is attached to first and second bottles, the longitudinal slit and the radial slits comprise a gap of predetermined width.

5. A bottle carrier according to claim 4 wherein the width of the gap is in a range from 1/16 to $\frac{1}{4}$ inches (0.159 to 0.635 cm).

6. A bottle carrier according to claim 1 wherein inner edges of the first and second web portions are angularly offset from one another.

7. A bottle carrier according to claim 1 wherein the carrier is constructed of a plastic material of sufficient flexibility and stiffness to allow a user to pull apart the first and second web portions to facilitate insertion or removal of a bottle from a respective collar.

8. A bottle carrier according to claim 1 wherein each of the first and second web portions comprises a relatively thin flat plate of planar construction coplanar with the first and second collars and a stiffening element perpendicularly extending from an outer side edge of the web portion for providing structural stiffness to the web portion in the direction perpendicular to the radial direction.

9. A bottle carrier according to claim 8 wherein the stiffening elements are inwardly curved.

10. A bottle carrier according to claim 1 wherein each of the first and second web portions comprises a stiffening member attached thereto for providing structural stiffness to the web portion in the direction perpendicular to the radial direction.

11. A bottle carrier according to claim 1 wherein the web portions and the first and second collars have a thickness of approximately 3/32 inches.

12. A bottle carrier comprising a one-piece injection molded construction including a first collar and a second collar in coplanar arrangement and being tangentially connected to opposite sides of a central handle piece, the first and second collars each having a radial slit along a radius proximate to respective connection to the central handle piece, the central handle piece comprising a first web portion connected at opposite ends thereof to the first and second collars on one side of the respective radial slits and a second web portion parallel to the first web portion connected at opposite ends thereof to the first and second collars on the other side of the respective slits, wherein the first and second web portions have inner edges which are angled in opposite directions proximate to one another to allow the first and second web portions to overlap when grasped by a user.

13. A bottle carrier comprising an elongated central section;

a first collar comprising a ring means of a thin and flat plate construction, for providing a stiff structure in a radial direction and a flexible structure in a direction perpendicular to the radial direction, the ring means having a first aperture and attached to one end of the central section and removably connectable around a neck of a first bottle;

a second collar comprising a ring means, of a thin and flat plate construction, for providing a stiff structure in a radial direction and a flexible structure in a direction perpendicular to the radial direction, the ring means having a first aperture and attached to the other end of the central section and removably connectable around a neck of a second bottle;

wherein the elongated central section includes means for providing additional connection strength of the first and second collars to the respective bottles in response to grasping of the central section.

14. A bottle carrier according to claim 13 wherein the means for providing additional connection strength comprises a longitudinal slit in the central section colinear with a radial slit along an inner radius of each of the first and second collars.

15. A bottle carrier according to claim 13 wherein the carrier is made out of plastic in a one-piece injection molded construction.

16. A container carrier comprising connector means, comprised of a ring-shaped collar means of a thin and flat plate construction for providing a stiff structure in a radial direction and a flexible structure in a direction perpendicular to the radial direction, the collar means having a radial slit through one side thereof, for removable connection to a neck portion of a container;

a "U" shaped handle having opposing first and second leg portions and a central grip portion, the first leg portion comprising a first web section attached to the ring-shaped collar means proximate to and on one side of the radial slit and a second web section attached to the ring-shaped collar means proximate to and on an opposite side of the radial slit, the second leg portion being attached to the ring-shaped collar means distal to the radial slit, the first web section being separated from the second web section by a gap extending from at least the radial slit to the grip portion; and means for providing additional connection strength of the collars means to a container in response to grasping of the central grip portion.

17. A container carrier according to claim 16 wherein the carrier is made out of plastic in a one-piece injection molded construction.

18. A carrier device comprising at least a first connector including a collar having a radial slit completely through one side thereof, the collar comprising a ring means of relatively thin and flat plate construction, for providing a stiff structure in a radial direction and a flexible structure in a direction perpendicular to the radial direction, the ring means having a circular central aperture with a given internal diameter and being removably connectable to a neck portion of a first container;

a handle having first and second grip portions, the first grip portion being attached to the collar proximate to and on one side of the radial slit and a second grip portion attached to the collar proximate to and on an opposite side of the radial slit, wherein the handle includes means to reduce the given internal diameter of the collar upon grasping of the handle for providing additional connection strength of the first connector to the first container.

19. A carrier device according to claim 18 further comprising a second connector including a second collar having a second radial slit completely through one side thereof, the second collar comprising a ring means, of flat plate construction, for providing a stiff structure in a radial direction and a flexible structure in a direction perpendicular to the radial direction, the ring means having a circular central aperture of a given internal diameter and being removably connectable to a neck portion of a second container, wherein, the first grip portion being attached to the second collar proximate to and on one side of the second radial slit and the second grip portion being attached to the second collar proximate to and on an opposite side of the second radial slit.

* * * * *